US011276907B2

(12) United States Patent
Pivit et al.

(10) Patent No.: US 11,276,907 B2
(45) Date of Patent: Mar. 15, 2022

(54) APPARATUS FOR RADIO FREQUENCY SIGNALS AND METHOD OF MANUFACTURING SUCH APPARATUS

(71) Applicant: Nokia Solutions and Networks Oy, Espoo (FI)

(72) Inventors: Florian Pivit, Dublin (IE); Senad Bulja, Dublin (IE)

(73) Assignee: NOKIA SOLUTIONS AND NETWORKS OY, Espoo (FI)

( * ) Notice: Subject to any disclaimer, the term of this patent is extended or adjusted under 35 U.S.C. 154(b) by 0 days.

(21) Appl. No.: 16/823,395

(22) Filed: Mar. 19, 2020

(65) Prior Publication Data

US 2020/0313265 A1 Oct. 1, 2020

(30) Foreign Application Priority Data

Mar. 26, 2019 (EP) ..... 19165262

(51) Int. Cl.

| | |
|---|---|
| ***H01P 1/205*** | (2006.01) |
| ***H01P 1/203*** | (2006.01) |
| ***H01P 7/10*** | (2006.01) |
| ***H01P 11/00*** | (2006.01) |

(52) U.S. Cl.

CPC ..... *H01P 1/2056* (2013.01); *H01P 1/20345* (2013.01); *H01P 7/10* (2013.01); *H01P 11/008* (2013.01)

(58) Field of Classification Search

CPC .. H01P 1/2056; H01P 1/20345; H01P 1/2053; H01P 7/10; H01P 1/2002; H01P 11/008; H05K 1/18

USPC ..... 333/202, 203, 206, 207, 222, 223

See application file for complete search history.

(56) References Cited

U.S. PATENT DOCUMENTS

| | | | | |
|---|---|---|---|---|
| 5,828,275 | A | 10/1998 | Kita et al. | |
| 6,222,431 | B1 * | 4/2001 | Ishizaki | H01P 1/20345 333/202 |
| 6,426,725 | B2 * | 7/2002 | Hiroshima | H01P 1/2056 333/134 |

(Continued)

FOREIGN PATENT DOCUMENTS

| | | |
|---|---|---|
| CN | 103811835 A | 5/2014 |
| CN | 207082619 U | 3/2018 |

(Continued)

OTHER PUBLICATIONS

Schuette et al., "Strong Coupling (Crosstalk) between Printed Microstrip and Complementary Split Ring Resonator (CSRR) Loaded Transmission Lines in Multilayer Printed Circuit Boards (Pcb)", IEEE International Conference on Electro Information Technology (EIT), May 19-21, 2016, pp. 1-4.

(Continued)

*Primary Examiner* — Robert J Pascal
*Assistant Examiner* — Jorge L Salazar, Jr.
(74) *Attorney, Agent, or Firm* — Mendelsohn Dunleavy, P.C.; Yuri Gruzdkov

(57) ABSTRACT

Apparatus comprising a first layer of electrically conductive material, a second layer of electrically conductive material, and at least one dielectric layer, which comprises a solid dielectric material, arranged between said first layer and said second layer, wherein at least one distributed resonator structure comprising a plurality of resonator posts is arranged in said at least one dielectric layer.

10 Claims, 5 Drawing Sheets

(56) References Cited

U.S. PATENT DOCUMENTS

| | | | |
|---|---|---|---|
| 2004/0000425 | A1 | 1/2004 | White et al. |
| 2005/0217786 | A1 | 10/2005 | Geller et al. |
| 2007/0080760 | A1 | 4/2007 | Alford |
| 2009/0102580 | A1 | 4/2009 | Uchaykin |
| 2010/0244984 | A1 | 9/2010 | Fukunaga |
| 2015/0318618 | A1 | 11/2015 | Chen et al. |
| 2017/0069943 | A1 | 3/2017 | Chayat |

FOREIGN PATENT DOCUMENTS

| | | | |
|---|---|---|---|
| EP | 0704924 | A1 | 4/1996 |
| EP | 0840390 | A1 | 5/1998 |
| EP | 3012902 | A1 | 4/2016 |
| EP | 3285331 | A1 | 2/2018 |
| JP | H07142914 | A | 6/1995 |
| JP | H0983212 | A | 3/1997 |
| JP | H1028006 | A | 1/1998 |

OTHER PUBLICATIONS

Extended European Search Report received for corresponding European Patent Application No. 19165262.7, dated Oct. 1, 2019, 7 pages.

Office action received for corresponding Chinese Patent Application No. 202010217778.3, dated Apr. 6, 2021, 8 pages of office action and 3 pages of Translation available.

* cited by examiner

APPARATUS FOR RADIO FREQUENCY SIGNALS AND METHOD OF MANUFACTURING SUCH APPARATUS

CROSS-REFERENCE TO RELATED APPLICATION

This application claims the benefit of European patent application No. 19165262.7 filed on Mar. 26, 2019, titled "APPARATUS FOR RADIO FREQUENCY SIGNALS AND METHOD OF MANUFACTURING SUCH APPARATUS", the content of which is incorporated herein by reference in its entirety.

FIELD OF THE INVENTION

Exemplary embodiments relate to an apparatus comprising a first layer of electrically conductive material, a second layer of electrically conductive material, and at least one dielectric layer, which comprises a solid dielectric material, arranged between said first layer and said second layer.

Further exemplary embodiments relate to a method of manufacturing such apparatus.

BACKGROUND

Apparatus of the aforementioned type can be used to process radio frequency, RF, signals.

SUMMARY

Exemplary embodiments relate to an apparatus comprising a first layer of electrically conductive material, a second layer of electrically conductive material, and at least one dielectric layer, which comprises a solid dielectric material, arranged between said first layer and said second layer, wherein at least one distributed resonator structure comprising a plurality of resonator posts is arranged in said at least one dielectric layer. This enables to provide a compact layer stack that comprises one or more distributed resonator structures which may e.g. be used to provide a resonator filter.

According to further exemplary embodiments, at least a first resonator post of said plurality of resonator posts is electrically connected to said first layer of electrically conductive material, and at least a second resonator post of said plurality of resonator posts is electrically connected to said second layer of electrically conductive material. This way, a particularly small and efficient distributed resonator may be provided.

According to further exemplary embodiments, said resonator posts are placed relative to each other such that a strong capacitive coupling is achieved between them, which results in a lowering of a resonance frequency, enabling an electrically short structure. For example, according to further exemplary embodiments, the electrical length of said resonator may be in a range of about 1/30 of a wavelength of the RF signals, which enables a particularly compact design.

According to further exemplary embodiments, at least some resonator posts may comprise a, preferably circular, cylindrical geometry, with a longitudinal axis of said cylindrical geometry extending perpendicular to a virtual plane defined by first and/or second layer of electrically conductive material. According to further exemplary embodiments, a first plurality of resonator posts is electrically connected to said first layer, and a second plurality of resonator posts is electrically connected to said second layer, According to further exemplary embodiments, at least one of said plurality of resonator posts comprises at least one of: a through hole or a blind hole, wherein an inner surface of the respective hole comprises an electrically conductive layer. According to further exemplary embodiments, said electrically conductive layer on the inner surface of a respective hole may comprise a plating with an electrically conductive material such as e.g. copper (and/or aluminium and/or brass and/or silver and/or gold) and/or a metallization.

According to further exemplary embodiments, said at least one through hole extends through a complete thickness of said at least one dielectric layer (and optionally also through at least one of said first and/or second layers of electrically conductive material).

According to further exemplary embodiments, said at least one blind hole only extends partially through a thickness of said at least one dielectric layer (and optionally also through one of said first and/or second layer of electrically conductive material).

According to further exemplary embodiments, said at least one through hole and/or blind hole may be provided by drilling and/or milling.

According to further exemplary embodiments, said first layer and/or said second layer is an electrically conductive plating or metallization (e.g. comprising at least one of: copper and/or aluminium and/or brass and/or silver and/or gold) arranged on a) a surface of said dielectric layer and/or on b) a surface of at least one further dielectric layer.

In other words, according to further exemplary embodiments, at least one further dielectric layer (i.e., in addition to said at least one dielectric layer between said first and second conductive layers) may be provided, which may comprise said first layer and/or said second layer.

According to further exemplary embodiments, said first layer and said second layer are electrically conductively connected to each other, e.g. for forming a ground plane for said at least one distributed resonator structure.

According to further exemplary embodiments, a plurality of dielectric layers is arranged between said first layer and said second layer. I.e., in other words, according to further exemplary embodiments, instead of one single layer of solid dielectric material between said first and second conductive layers, more than one layer of solid dielectric material may be provided between said first and second conductive layers.

According to further exemplary embodiments, at least one of said plurality of dielectric layers comprises a hole for forming a part of at least one of said plurality of resonator posts. According to further exemplary embodiments, at several ones of said plurality of dielectric layers comprise one or more holes for forming a respective part of at least one of said plurality of resonator posts.

According to further exemplary embodiments, said plurality of dielectric layers may be arranged adjacent to each other, forming a layer stack, wherein at least some holes of adjacent dielectric layers are aligned with each other to form said resonator posts.

According to further exemplary embodiments, a feed line for providing an input signal to the apparatus is arranged on a surface of said dielectric layer and/or on a surface of at least one further dielectric layer. According to further exemplary embodiments, said feed line may e.g. be implemented as a strip-line.

According to further exemplary embodiments, said dielectric layer comprises a first type of dielectric material, and said at least one further dielectric layer comprises a second type of dielectric material, which is different from said first type. According to further exemplary embodiments, said first type of dielectric material may e.g. comprise a smaller dielectric loss than said second type of dielectric material. This way, the overall costs of the apparatus can be optimized. As an example, the distributed resonator structure(s) are implemented within said "low-loss" dielectric material, whereas further dielectric layers e.g. for carrying a ground plane or one or more cavity walls of said distributed resonator structure(s) (e.g., by means of a respective metallic or electrically conductive layer arranged on said further dielectric layers), may be implemented with dielectric material that comprises a greater dielectric loss.

According to further exemplary embodiments, a) said first layer of electrically conductive material and/or said second layer of electrically conductive material comprises a structured section and/or b) at least one further layer of electrically conductive material is provided which comprises a structured section. According to further exemplary embodiments, the structured section may e.g. be used to form one or more strip-line(s), as e.g. mentioned above for providing an input signal to the apparatus and/or to one of its distributed resonator structure, and/or for guiding an output signal of the apparatus and the like.

According to further exemplary embodiments, the structured section may also comprise one or more conductive paths, e.g. for electrically conductively contacting one or more electric and/or electronic elements which may, according to further exemplary embodiments, be provided on said apparatus. This way, said one or more electronic elements may directly be integrated into the apparatus, whereby e.g. an integrated RF filter may be provided together with further electric circuitry.

Further exemplary embodiments relate to a filter for radio frequency, RF, signals comprising at least one apparatus according to the embodiments.

Further exemplary embodiments relate to a method of manufacturing an apparatus comprising a first layer of electrically conductive material, a second layer of electrically conductive material, and at least one dielectric layer, which comprises a solid dielectric material, and which is arranged between said first layer and said second layer, said method comprising: providing said at least one dielectric layer, providing said first layer of electrically conductive material on a first surface of said at least one dielectric layer, providing said second layer of electrically conductive material on a second surface of said at least one dielectric layer, providing at least one distributed resonator structure comprising a plurality of resonator posts in said at least one dielectric layer.

According to further exemplary embodiments, said first layer and said second layer are electrically conductively connected to each other, e.g. for forming a ground plane for said at least one distributed resonator structure.

According to further exemplary embodiments, for at least some steps of the method according to the embodiments, aspects and methods of manufacturing printed circuit boards may advantageously be used, e.g. for arranging said first layer of electrically conductive material on said first surface of said at least one dielectric layer and/or for arranging said second layer of electrically conductive material on said second surface of said at least one dielectric layer.

According to further exemplary embodiments, said step of providing at least one distributed resonator structure comprises: providing at least one through hole and/or at least one blind hole, in said at least one dielectric layer, and optionally in said first layer of electrically conductive material and/or in said second layer of electrically conductive material.

According to further exemplary embodiments, said step of providing at least one distributed resonator structure comprises providing an electrically conductive layer on an inner surface of at least one of said holes.

According to further exemplary embodiments, said step of providing said at least one dielectric layer comprises providing a plurality of dielectric layers, wherein said step of providing at least one distributed resonator structure comprises: providing a plurality of holes in at least two of said plurality of dielectric layers, arranging said plurality of dielectric layers to form a stack of dielectric layers. According to further exemplary embodiments, said step of arranging is performed such that at least two holes of adjacent dielectric layers of said stack are aligned with each other, e.g. forming a respective resonator post.

According to further exemplary embodiments, said method further comprises: a) providing a structured section on said first layer of electrically conductive material and/or said second layer of electrically conductive material and/or b) providing at least one further layer of electrically conductive material and providing a structured section on said at least one further layer of electrically conductive material.

Further exemplary embodiments relate to a printed circuit board comprising at least one apparatus according to the embodiments and/or at least one filter according to the embodiments.

BRIEF DESCRIPTION OF THE FIGURES

Some exemplary embodiments will now be described with reference to the accompanying drawings in which FIG. 1A schematically depicts a cross-sectional side view of an apparatus according to exemplary embodiments, FIG. 1B schematically depicts a cross-sectional side view of an apparatus according to further exemplary embodiments, FIG. 1C schematically depicts a bottom view of an apparatus according to further exemplary embodiments, FIG. 2 schematically depicts a cross-sectional side view of an apparatus according to further exemplary embodiments, FIG. 3A schematically depicts a cross-sectional side view of an apparatus according to further exemplary embodiments, FIG. 3B schematically depicts a cross-sectional side view of an apparatus according to further exemplary embodiments, FIG. 4 schematically depicts a top view of a filter according to further exemplary embodiments, FIG. 5A schematically depicts scattering parameters over frequency according to further exemplary embodiments, FIG. 5B schematically depicts scattering parameters over frequency according to further exemplary embodiments, FIG. 6A schematically depicts a cross-sectional side view of aspects of an apparatus according to further exemplary embodiments, FIG. 6B schematically depicts a cross-sectional side view of the apparatus of FIG. 6A in a different state, FIG. 6C schematically depicts a cross-sectional side view of the apparatus of FIG. 6A in a different state, FIG. 7 schematically depicts a perspective view of an apparatus according to further exemplary embodiments, FIG. 8A schematically depicts a simplified flow chart of a method according to further exemplary embodiments, FIG. 8B schematically depicts a simplified flow chart of a method according to further exemplary embodiments, FIG. 8C schematically depicts a simplified flow chart of a method according to further exemplary embodiments, and FIG. 8D schematically depicts a simplified flow chart of a method according to further exemplary embodiments.

Figure 1A:
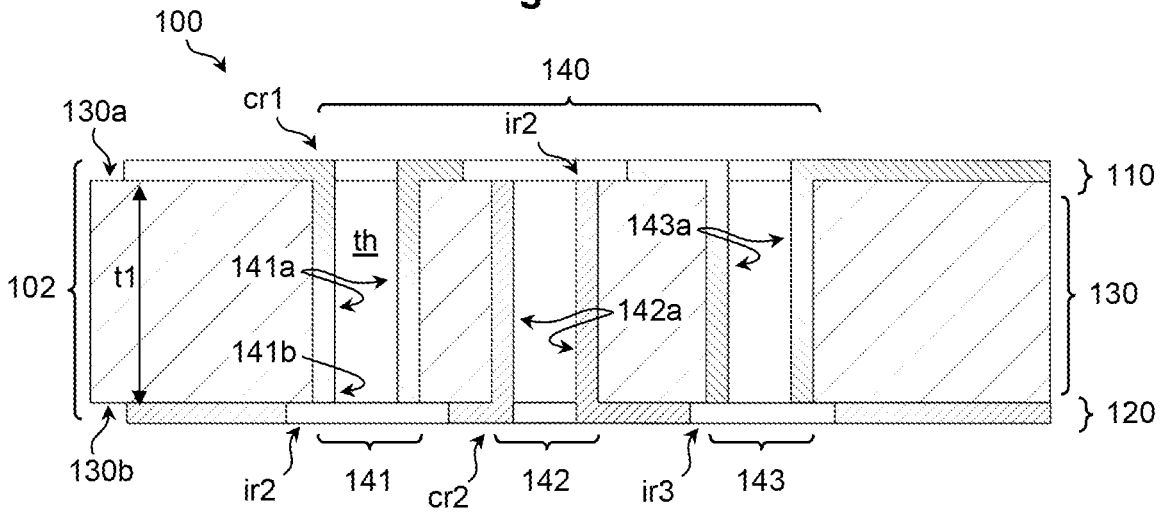
FIG. 1A schematically depicts a cross-sectional side view of an apparatus 100 according to exemplary embodiments. The apparatus 100 comprises a first layer 110 of electrically conductive material, a second layer 120 of electrically conductive material, and at least one dielectric layer 130, which comprises a solid dielectric material, arranged between said first layer 110 and said second layer 120, whereby a layer stack 102 comprising said layers 110, 120, 130 is obtained. Advantageously, at least one distributed resonator structure 140 comprising a plurality of resonator posts 141, 142, 143 is arranged in said at least one dielectric layer 130. This enables to provide a compact layer stack 102 that comprises one or more distributed resonator structures which may e.g. be used to provide a resonator filter for radio frequency, RF, signals. As a non-limiting example, the thickness t1 of the dielectric layer 130 may e.g. range between 1 millimeter (mm) and 10 mm, preferably 3 mm. According to further exemplary embodiments, however, the dielectric layer 130 may be thinner or thicker.

According to further exemplary embodiments, said resonator posts 141, 142, 143 are placed relative to each other such that a strong capacitive coupling is achieved between them, which results in a lowering of a resonance frequency, enabling an electrically short structure. For example, according to further exemplary embodiments, the electrical length of said resonator may be in a range of about 1/30 of a wavelength of the RF signals, which enables a particularly compact design.

According to further exemplary embodiments, said first layer 110 and said second layer 120 are electrically conductively connected to each other, e.g. for forming a ground plane for said at least one distributed resonator structure 140.

According to further exemplary embodiments, at least a first resonator post 141 of said plurality of resonator posts is electrically connected to said first layer 110 of electrically conductive material, and at least a second resonator post 142 of said plurality of resonator posts is electrically connected to said second layer 120 of electrically conductive material. This way, a particularly small and efficient distributed resonator 140 may be provided, which comprises an interdigital arrangement of various resonator posts. According to Applicant's analysis, by using said interdigital arrangement of various resonator posts, particularly small resonator lengths may be attained, e.g. in the range of 1/30 of a wavelength of the processed RF signals.

According to further exemplary embodiments, said first layer 110 may form a first, e.g. upper, cavity wall of a cavity of said distributed resonator structure 140, and said second layer 120 may form a second, e.g. lower, cavity wall of said cavity of said distributed resonator structure 140.

Preferably, one or more electrically conductive side walls for said cavity may be provided, which is not shown for reasons of clarity. However, according to further exemplary embodiments, such side walls may e.g. comprise an electrically conductive coating of side walls (preferably all side walls) of said dielectric layer 130. Preferably, said electrically conductive side walls may also be connected to said first and second layer 110, 120.

According to further exemplary embodiments, at least some resonator posts 141, 142, 143 may comprise a, preferably circular, cylindrical geometry, with a longitudinal axis of said cylindrical geometry extending perpendicular to a virtual plane defined by first and/or second layer 110, 120 of electrically conductive material, i.e. vertical in the side view of FIG. 1. According to further exemplary embodiments, a first plurality (or at least one) of resonator posts 141, 143 is electrically connected to said first layer 110, and a second plurality (or at least one) of resonator posts 142 is electrically connected to said second layer 120.

According to further exemplary embodiments, at least one of said plurality of resonator posts 141, 142, 143 comprises at least one of: a through hole or a blind hole, wherein an inner surface of the respective hole comprises an electrically conductive layer 141*a*, 142*a*, 143*a*. The exemplary embodiments according to FIG. 1A comprise through holes th. In this respect, FIG. 2 schematically depicts an apparatus 100*a* according to further exemplary embodiments, wherein a plurality of resonator posts 141', 142', 143' comprises blind holes bh. According to further exemplary embodiments, it is also possible to provide one or more resonator posts in the form of through holes th (FIG. 1) and one or more further resonator posts of said distributed resonator structure 140 in the form of blind holes bh (FIG. 2).

According to further exemplary embodiments, said electrically conductive layer 141*a*, 142*a*, 143*a* (FIG. 1A) on the inner surface of a respective hole th, bh may comprise a plating with an electrically conductive material such as e.g. copper (and/or aluminium and/or brass and/or silver and/or gold) and/or a corresponding metallization.

Figure 2:
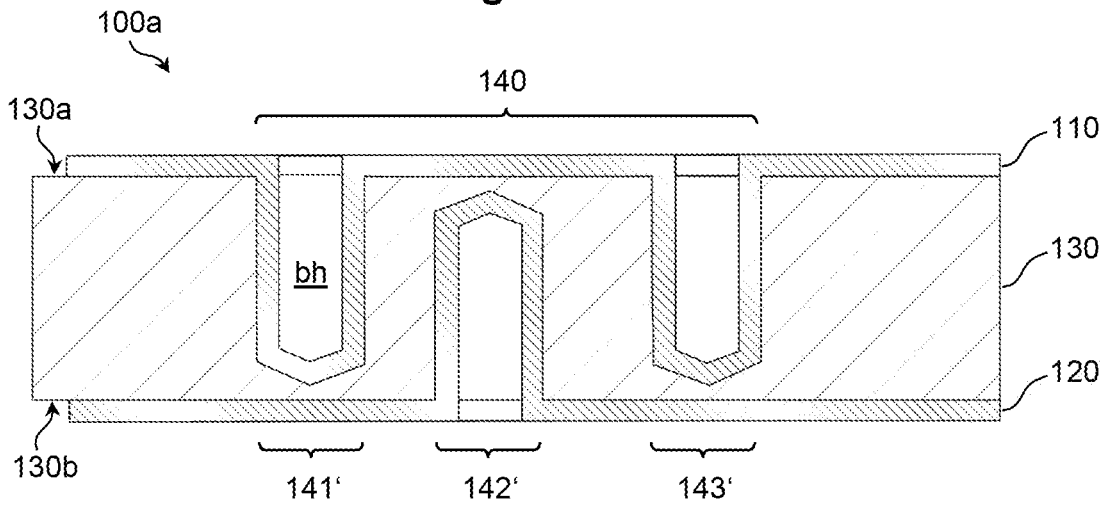

According to further exemplary embodiments, to enable an electrically conductive connection of a respective resonator post 141 (FIG. 1A) or its inner surface, respectively, with e.g. the first layer 110, said plating and/or metallization of the inner surface is arranged such that it makes electrically conductive contact with the respective layer 110, cf. the contact region cr1 of FIG. 1A for the first resonator post 141. According to further exemplary embodiments, this may also apply to one or more further resonator posts, cf. contact region cr2 exemplarily depicted by FIG. 1A for the second resonator post 142. Preferably, said plating and/or metallization of the inner surface may form an integral part of the respective layer 110, 120.

According to further exemplary embodiments, at least one resonator post 141 is electrically connected to said first layer 110, but electrically isolated from said second layer 120. According to further exemplary embodiments, this may be attained by providing an isolation region ir1 in which the electrically conductive material of the second layer 120 is at least partly removed (e.g., by milling) around an axial end section 141*b* of the resonator post 141. According to further exemplary embodiments, a similar configuration may be provided for at least one further resonator post 142, 143, cf. the isolation regions ir2, ir3.

According to further exemplary embodiments, said at least one through hole th (FIG. 1A) extends through a complete thickness t1 of said at least one dielectric layer (and optionally also through at least one of said first and/or second layers 110, 120 of electrically conductive material).

Figure 1B:
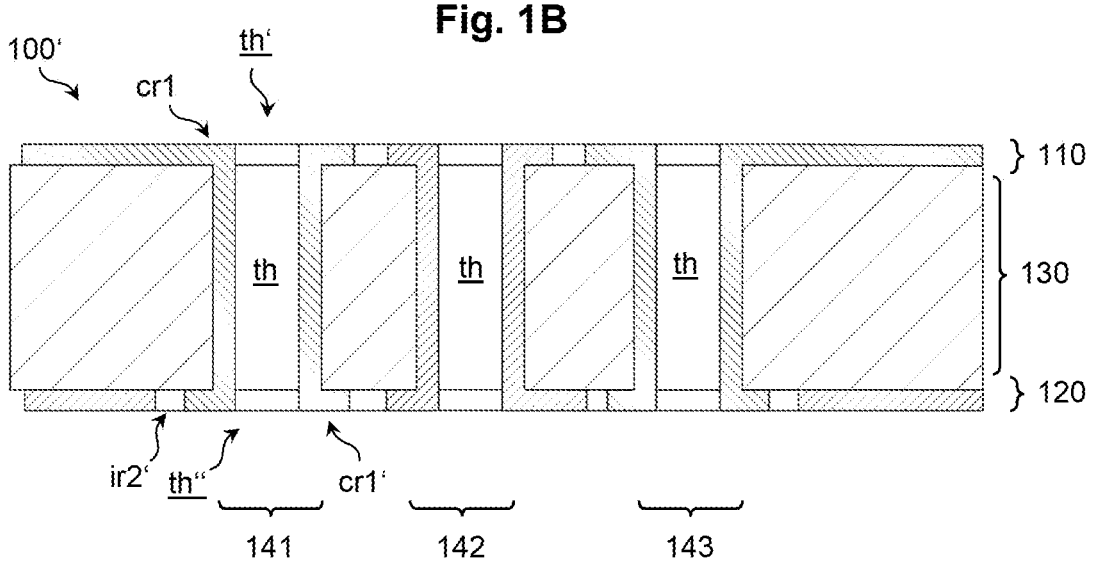

FIG. 1B schematically depicts a cross-sectional side view of an apparatus 100' according to further exemplary embodiments. The apparatus 100' comprises a structure similar to the apparatus 100 of FIG. 1A. In difference to FIG. 1A, the through holes th of FIG. 1B comprise electrically conductive connections to respective portions of electrically conductive material provided on the respective surface 130*a*, 130*b* (FIG. 1A) in both axial end sections th', th". As an example, the first axial end section th' of the through hole th of the resonator post 141 is electrically connected to the material of the first layer 110, and the second axial end section th" of the through hole th of the resonator post 141 is electrically connected to a portion cr1' of electrically conductive material (e.g., copper) on the second surface 130*b*, which portion cr1', however, is not electrically conductively connected to the second layer 120. This may e.g. be achieved by providing a basically ring-shaped annular isolation region ir2' surrounding portion cr1'.

Figure 1C:
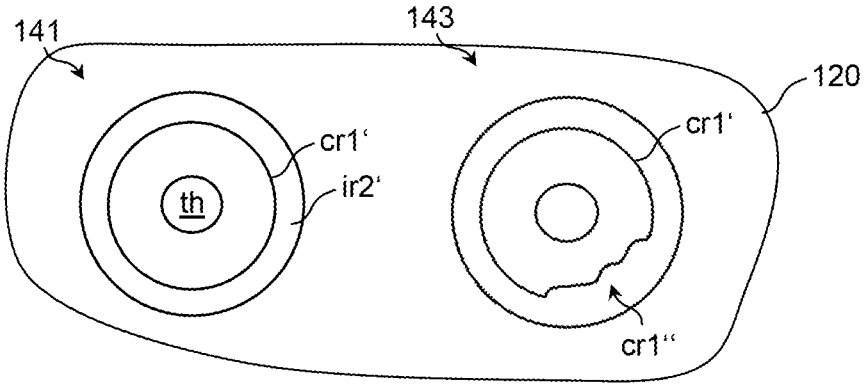

According to further preferred exemplary embodiments, also cf. the bottom view of FIG. 1C, said portion cr1' may also be referred to as a "catch pad". This enables precise manufacturing and a further possibility for tuning, as according to further exemplary embodiments, material may be removed from the catch pad (e.g. mechanically, by milling or grinding or the like, and/or by means of laser ablation). This is indicated for a catch pad cr1' of a further resonator post 143 in FIG. 1C, cf. reference sign cr1".

According to further exemplary embodiments, said at least one blind hole bh (FIG. 2) only extends partially through a thickness of said at least one dielectric layer 130 (and optionally also through one of said first 110 and/or second layer 120 of electrically conductive material).

According to further exemplary embodiments, said at least one through hole th and/or blind hole bh may be provided by drilling and/or milling.

According to further exemplary embodiments, said first layer 110 and/or said second layer 120 is an electrically conductive plating or metallization (e.g. comprising at least one of: copper and/or aluminium and/or brass and/or silver and/or gold) arranged on a) a surface 130*a*, 130*b* of said dielectric layer and/or on b) a surface 150*a* (cf. FIG. 6A further below) of at least one further dielectric layer. In the exemplary embodiments of FIG. 1A, 1B, 2, the first layer 110 is arranged on a first surface 130*a* of the dielectric layer 130, and the second layer 120 is arranged on a second surface 130*b* of the dielectric layer 130.

Figure 3A:
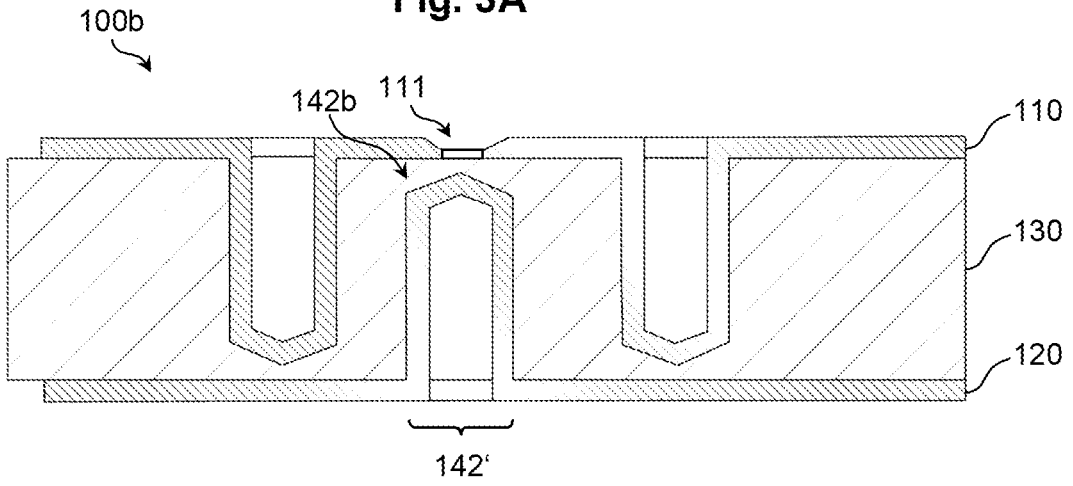

FIG. 3A schematically depicts a cross-sectional side view of an apparatus 100*b* according to further exemplary embodiments, which comprises a structure similar to the apparatus 100*a* of FIG. 2. However, as indicated by reference numeral 111 in FIG. 3A, a portion of the electrically conductive material of the first layer 110 is removed (preferably removed completely, along a vertical coordinate of FIG. 3A, i.e. down to the surface of the dielectric layer 130) in a region adjacent to an axial end section 142*b* of the resonator post 142', exemplarily implemented in the form of a blind hole with electrically conductively plated inner surface. This way, the distributed resonator structure can be tuned, e.g. to influence a resonant frequency and/or bandwidth and the like. According to further exemplary embodiments, said material 111 may be removed by means of laser radiation, e.g. laser ablation, and/or chemical removal, e.g. etching, and/or mechanical removal, i.e. drilling and/or milling and/or grinding.

Figure 3B:
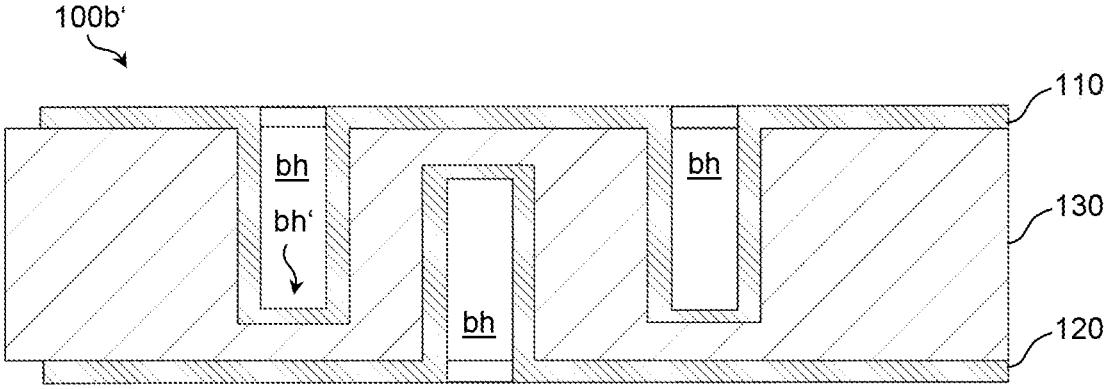

FIG. 3B schematically depicts a cross-sectional side view of an apparatus 100*b*' according to further exemplary embodiments, which comprises a structure similar to the apparatus 100*b* of FIG. 3A. In difference to FIG. 3A, the blind holes bh of FIG. 3B comprise a flat bottom section bh'.

Figure 4:
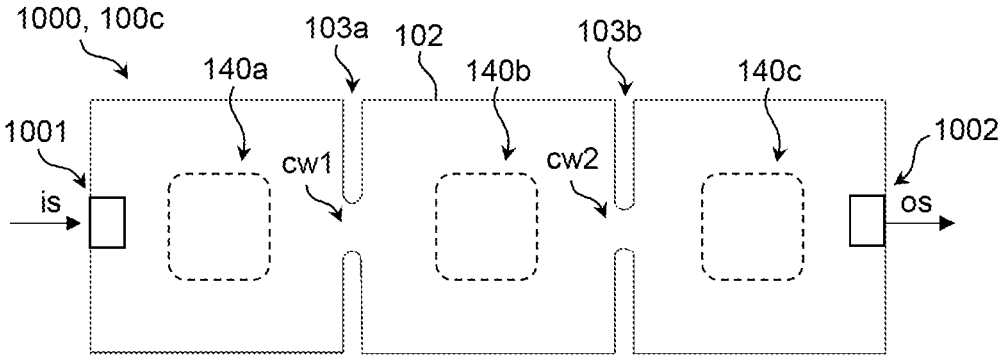

FIG. 4 schematically depicts a top view of a filter 1000 for RF signals according to further exemplary embodiments. The filter 1000 comprises an apparatus 100*c* according to the embodiments, e.g. having a layer structure as exemplarily depicted by FIG. 1A to FIG. 3B, wherein said apparatus 100*c* presently comprises three distributed resonator structures 140*a*, 140*b*, 140*c*, whereby an three-pole-filter is attained. A coupling between adjacent distributed resonator structures 140*a*, 140*b*, 140*c* may be controlled by providing slots 103*a*, 103*b* into the apparatus 100*c*, i.e. the layer stack 102, whereby coupling windows cw1, cw2 are defined in the form of the remaining portions of the layer stack 102 between said slots 103*a*, 103*b*.

According to further exemplary embodiments, the filter 1000 comprises an input port 1001 for receiving an input signal is, which may e.g. be an RF signal having spectral components within a frequency range between 1.0 GHz (gigahertz) and 1.3 GHz. As an example, said input port 1001 may comprise a coaxial RF connector for coupling to a coaxial supply line (not shown).

According to further exemplary embodiments, the filter 1000 comprises an output port 1002 for providing an output signal os, which is a filtered version of said input signal is. As an example, said output port 1002 may also comprise a coaxial RF connector for coupling to a coaxial line (not shown).

According to further exemplary embodiments, each of said distributed resonator structures 140*a*, 140*b*, 140*c* may comprise 9 resonator posts (not shown), wherein e.g. five resonator posts are connected to the first layer 110 (similar to the exemplary posts 141, 143 of FIG. 1), and wherein e.g. four resonator posts are connected to the second layer 120 (similar to the exemplary post 142 of FIG. 1), i.e. nine resonator posts in total. Preferably, said nine resonator posts may be arranged in three rows of three resonator posts each, forming a 3×3 cluster. In this regard, the distributed resonator structures 140*a*, 140*b*, 140*c* may also be denoted as "3×3 resonator cluster", and the filter 1000 may also be denoted as "3 pole inline filter".

According to further exemplary embodiments, a frequency of operation of said filter 1000 may e.g. be 1.1 GHz. This may be controlled e.g. by the number and/or placement and/or geometry of the resonator posts and/or the solid dielectric material (e.g., a ceramic substrate material for RF applications) of the layer 130.

According to further exemplary embodiments, a length (along a horizontal coordinate of FIG. 4) may e.g. be 90 mm, a width (along a vertical coordinate of FIG. 4) may e.g. be 30 mm, and a thickness of said stack 102 may e.g. be 3 mm.

Advantageously, said filter 1000 may e.g. represent a printed circuit board or may be integrated into a printed circuit board.

Figure 5A:
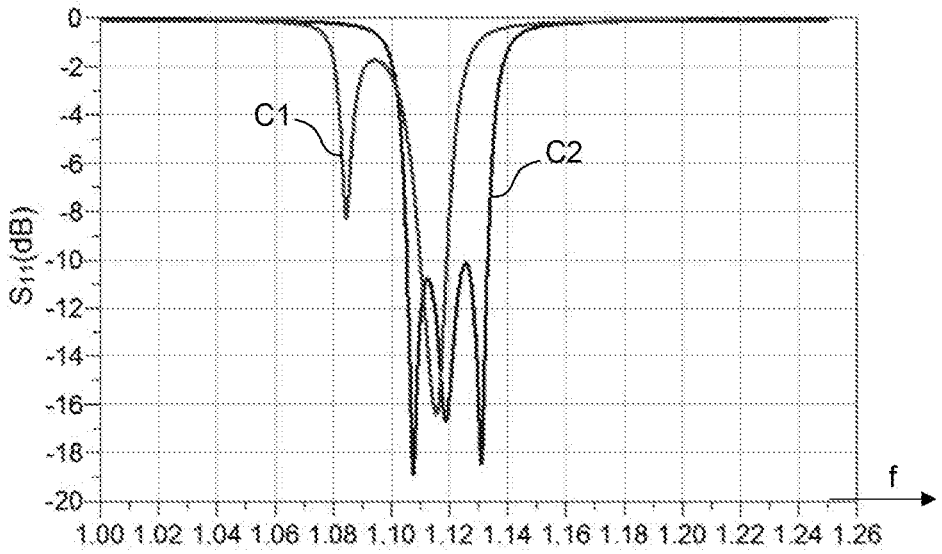

FIG. 5A schematically depicts scattering parameters over frequency for the filter 1000 of FIG. 4 according to further exemplary embodiments. Curve C1 depicts scattering parameter $S_{11}$ (input reflection coefficient at input port 1001, FIG. 4) in dB (decibel) over frequency f in a first, untuned state, and curve C2 depicts said scattering parameter $S_{11}$ in a tuned state, which may e.g. be attained by one or more steps of tuning as explained above with reference to FIG. 3A, reference sign 111.

Figure 5B:
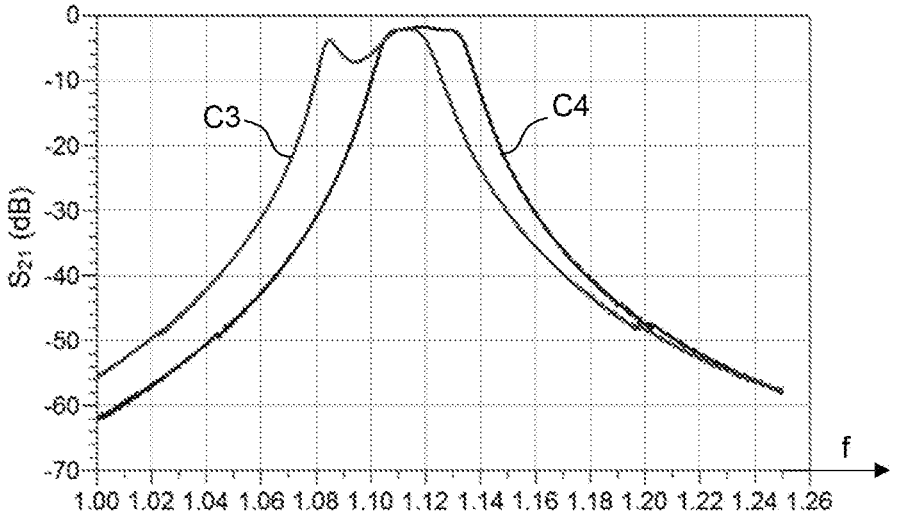

FIG. 5B schematically depicts scattering parameters over frequency for the filter 1000 of FIG. 4 according to further exemplary embodiments. Curve C3 depicts scattering parameter $S_{21}$ (forward gain for transmission of input signal is from input port 1101 to output port 1102) in dB (decibel) over frequency f in a first, untuned state, and curve C4 depicts said scattering parameter $S_{21}$ in a tuned state. It can be seen that the apparatus according to exemplary embodiments and/or the filter 1000 according to exemplary embodiments can efficiently be tuned in a very cost-effective manner.

Figure 6A:
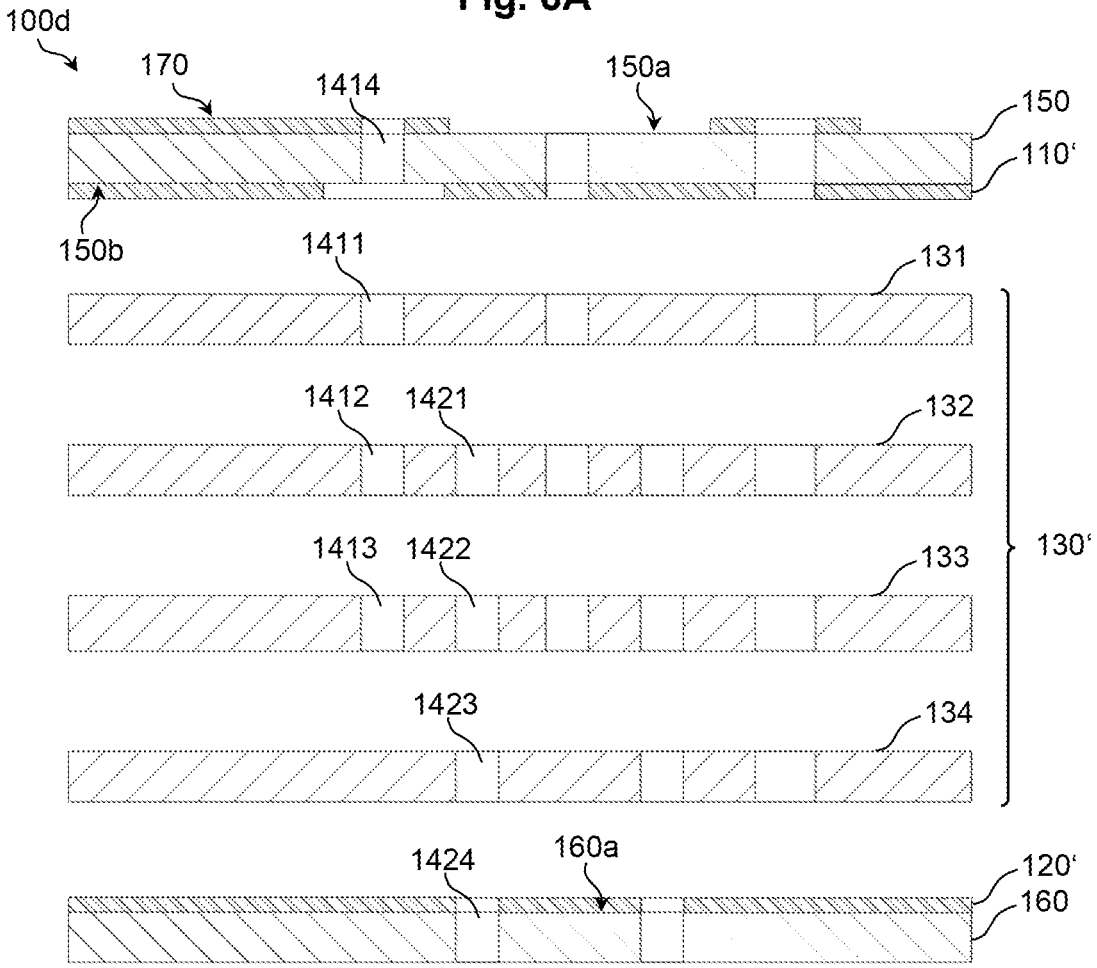

FIG. 6A schematically depicts a cross-sectional side view of aspects of an apparatus 100*d* according to further exemplary embodiments. While apparatus 100*d* comprises a first layer 110' of electrically conductive material and a second layer 120' of electrically conductive material, similar to layers 110, 120 of the apparatus 100 of FIG. 1, by contrast, a plurality 130' of dielectric layers 131, 132, 133, 134 is arranged between said first layer 110' and said second layer 120'. I.e., in other words, according to further exemplary embodiments, instead of one single layer 130 (FIG. 1) of solid dielectric material between said first and second conductive layers 110', 120', more than one layer of solid dielectric material may be provided between said first and second conductive layers.

Presently, also two further dielectric layers 150, 160 (i.e., in addition to the dielectric layers 131, 132, 133, 134 between said first and second conductive layers 110', 120') are provided, which comprise said first layer 110' and said second layer 120'.

Figure 6B:
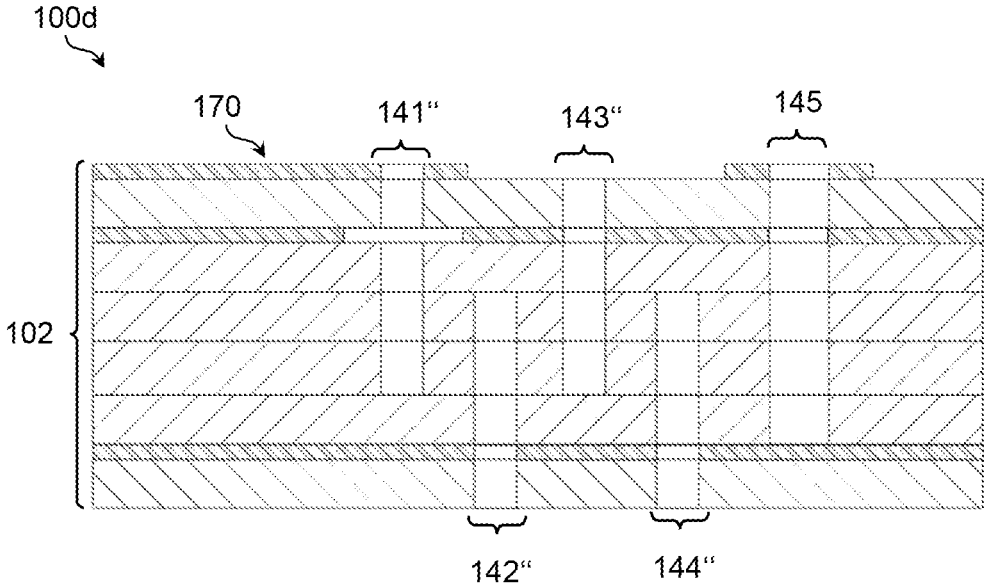

FIG. 6A exemplarily depicts the various layers 150, 110', 131, 132, 133, 134, 120', 160 at a comparatively early stage of a manufacturing process according to further exemplary embodiments, wherein said layers are provided in the form of individual layers, i.e. not (yet) attached to each other. By contrast, FIG. 6B depicts the apparatus 100*d* at a later stage, after said individual layers have been arranged adjacent to each other, i.e. by means of a lamination process.

As can be seen from FIG. 6A, at least one of said plurality 130' of dielectric layers comprises a hole for forming a part of at least one of said plurality of resonator posts.

According to further exemplary embodiments, several ones of said plurality of dielectric layers comprise one or more holes for forming a respective part of at least one of said plurality of resonator posts. As an example, layers 131, 132, 133 comprise respective holes 1411, 1412, 1413 for forming a first resonator post 141", cf. the exemplary laminated state of FIG. 6B. As can be seen from FIG. 6A, also the further dielectric layer 150 comprises a hole 1414 that contributes to a formation of the first resonator post 141". Similarly, layers 132, 133, 134, 160 comprise respective holes 1421, 1422, 1423, 1424 for forming a second resonator post 142", cf. the laminated state depicted by FIG. 6B.

Further resonator posts 143", 144" may be provided similarly, i.e. by providing respective holes in the various layers of the stack 102, preferably prior to laminating.

Figure 6C:
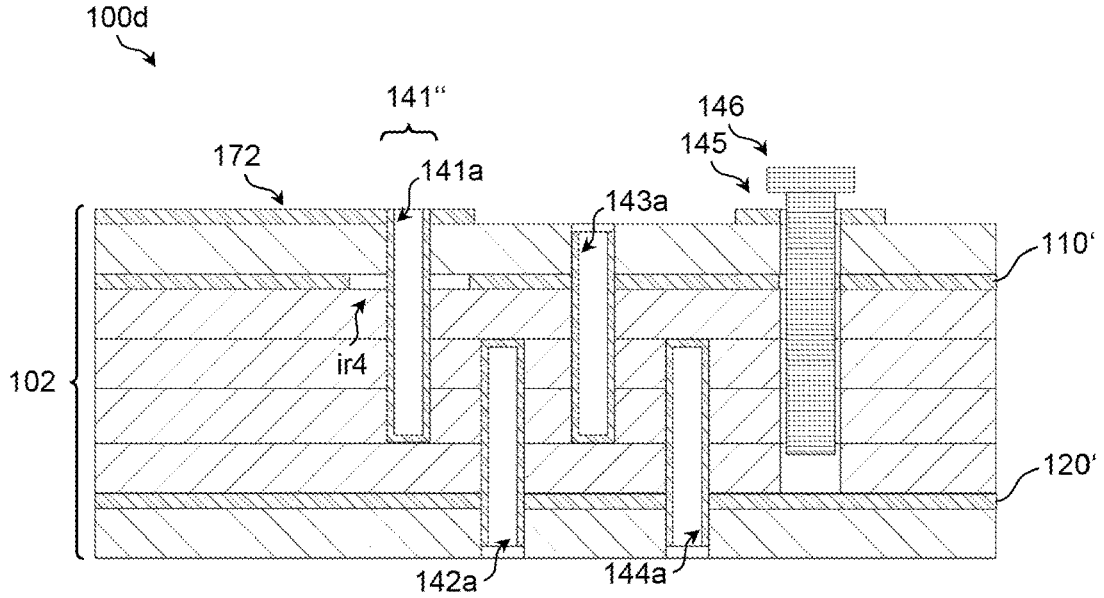

According to further exemplary embodiments, at least one tuning opening 145 may also be provided similarly, i.e. by providing individual holes in various layers, presently e.g. layers 150, 110', 131, 132, 133, 134, said holes being aligned with each other to form said tuning opening 145 after lamination. According to further exemplary embodiments, a tuning element such as a tuning screw 146 (FIG. 6C) may be inserted into the tuning opening to tune the RF signal processing properties of the apparatus 100*d* or its distributed resonator structure.

According to further exemplary embodiments, as mentioned above, said plurality 130' of dielectric layers 131, 132, 133, 134 may be arranged adjacent to each other, forming a layer stack, wherein at least some holes of adjacent dielectric layers are aligned with each other to form said resonator posts 141", 142", 143", 144". Preferably, according to further exemplary embodiments, a lamination process may be applied to attach the dielectric layers 131, 132, 133, 134 to each other. According to further exemplary embodiments, the further dielectric layers 150, 160 may also be included in such lamination process.

According to further exemplary embodiments, the holes of one or more of said resonator posts 141", 142", 143", 144" may be provided with an electrically conductive layer 141*a* (FIG. 6C), 142*a*, 143*a*, 144*a*, i.e. by plating with an electrically conductive coating. According to further exemplary embodiments, said electrically conductive layer of the resonator posts may be connected to at least one of said conductive layers 110', 120'. Presently, as an example, according to FIG. 6C, the conductive layer 143*a* of resonator post 143" (FIG. 6B) is electrically conductively connected to said conductive layer 110', whereas the conductive layers 142*a*, 144*a* of resonator posts 142", 144" are electrically conductively connected to said conductive layer 120'.

According to further exemplary embodiments, the tuning opening 145 is not plated, i.e. not provided with an electrically conductive inner surface.

According to further exemplary embodiments, at least one further layer 170 (FIG. 6A) of electrically conductive material is provided, presently on the first surface 150*a* of the further dielectric layer 150. The second surface 150*b* of the further dielectric layer 150 comprises the first conductive layer 110'.

According to further exemplary embodiments, said at least one further layer 170 of electrically conductive material comprises a structured section, e.g. for forming a feed line 172 (FIG. 6C) for the apparatus 100*d*, e.g. as a strip-line. This feed line 172 may e.g. be connected with the first resonator post 141" (FIG. 6B), also cf. FIG. 6C, whereby a "feed pin" is defined, e.g. for providing an input signal to the distributed resonator structure. In this variant, the first resonator post 141" is not connected with the first conductive layer 110', but rather isolated from said first conductive layer 110', e.g. by providing a respective isolation region ir4 (FIG. 6C) (e.g., by removing electrically conductive material from layer 110' prior to laminating).

According to further exemplary embodiments, said structured section of layer 170 may also be used to provide one or more tuning elements (not shown), and/or conductive paths and the like.

According to further exemplary embodiments, the structured section of the further conductive layer 170 may e.g. be used to form one or more strip-line(s), as e.g. mentioned above for providing an input signal to the apparatus and/or to one of its distributed resonator structures, and/or for guiding an output signal of the apparatus and the like.

According to further exemplary embodiments, said dielectric layer(s) 130 (FIG. 1), 131, 132, 133, 134 (FIG. 6A) comprise(s) a first type of dielectric material, and said at least one further dielectric layer 150, 160 (FIG. 6A) comprises a second type of dielectric material, which is different from said first type. According to further exemplary embodiments, said first type of dielectric material may e.g. comprise a smaller dielectric loss than said second type of dielectric material. This way, the overall costs of the apparatus can be optimized. As an example, the distributed resonator structure(s) 140 are implemented within said "low-loss" dielectric material 130, 130', whereas further dielectric layers 150, 160 e.g. for carrying a ground plane 120' (FIG. 6A) or one or more cavity walls of said distributed resonator structure(s) (e.g., by means of a respective metallic or electrically conductive layer arranged on said further dielectric layers 150, 160), may be implemented with dielectric material that comprises a greater dielectric loss.

According to further exemplary embodiments, the structured section within the further conductive layer 170 (FIG. 6C) may also comprise one or more conductive paths (not shown), e.g. for electrically conductively contacting one or more electric and/or electronic elements (not shown) which may, according to further exemplary embodiments, be provided on said apparatus according to the embodiments. This way, said one or more electronic elements may directly be integrated into the apparatus, whereby e.g. an integrated RF filter may be provided together with further electric circuitry such as an amplifier and/or (de)modulator and the like.

Figure 7:
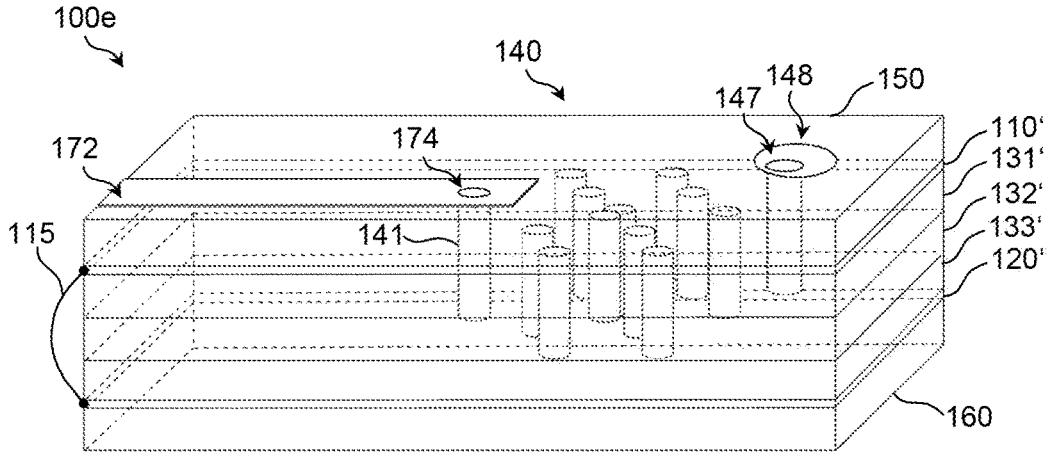

FIG. 7 schematically depicts a perspective view of an apparatus 100*e* according to further exemplary embodiments. The apparatus 100*e* comprises first and second layers 110', 120' of electrically conductive material, e.g. a copper plating, arranged on respective surfaces of further dielectric layers 150, 160, whereas three dielectric layers 131', 132', 133' are arranged between said conductive layers 110', 120'. Within said three dielectric layers 131', 132', 133', a distributed resonator structure 140 is arranged, wherein only on resonator post 141 thereof is individually referenced in FIG. 7. Said resonator post 141 is electrically connected in a connection region 174 to a feed line 172, which enables to provide an input signal to the apparatus 100*e*. Some of the further resonator posts of FIG. 7 are electrically connected to the first conductive layer 110' (but not to the second conductive layer 120'), and some others of the further resonator posts of FIG. 7 are electrically connected to the second conductive layer 120' (but not to the first conductive layer 110'), similar to FIG. 6C. One of said further resonator posts is assigned a tuning pattern 148, which is electrically connected to said tuning pattern 148 in a connection region 147. The tuning pattern 148 may e.g. be implemented as a structured section of the further conductive layer 170 (also cf. FIG. 6A). By altering the size and/or shape of the tuning pattern 148, the apparatus 100*e* may be tuned.

According to further exemplary embodiments, more than one resonator post may be provided with a respective tuning pattern 148, which is easily accessibly from the outside of the apparatus 100*e*. According to further exemplary embodiments, at least one tuning pattern may also be provided in at least one of the layers 120', 160, instead of layer 170.

According to further exemplary embodiments, said first layer 110' and said second layer 120' are electrically conductively connected to each other, cf. the connection 115 of FIG. 7, e.g. for forming a ground plane for said at least one distributed resonator structure.

According to further exemplary embodiments, said apparatus 100*e*, too, may comprise electrically conductive side walls (not shown) which may e.g. be connected with said first and second layer 110', 120'.

Figure 8A:
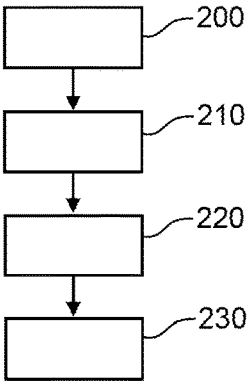

Further exemplary embodiments, cf. the flow chart of FIG. 8A, relate to a method of manufacturing an apparatus according to the embodiments, said apparatus 100 comprising a first layer 110 (FIG. 1) of electrically conductive material, a second layer 120 of electrically conductive material, and at least one dielectric layer 130, which comprises a solid dielectric material, and which is arranged between said first layer 110 and said second layer 120, said method comprising: providing 200 (FIG. 8A) said at least one dielectric layer 130, providing 210 said first layer 110 of electrically conductive material on a first surface 130*a* (FIG. 1) of said at least one dielectric layer 130, providing 220 (FIG. 8A) said second layer 120 of electrically conductive material on a second surface 130*b* of said at least one dielectric layer 130, providing 230 at least one distributed resonator structure 140 (FIG. 1) comprising a plurality of resonator posts 141, 142, 143 in said at least one dielectric layer 130.

According to further exemplary embodiments, the sequence of steps 200, 210, 220, 230 of FIG. 8A may e.g. be used to provide the apparatus 100 of FIG. 1. However, according to further exemplary embodiments, said steps may also be performed in another sequence, i.e. 200, 230, 210, 220, and the like.

According to further exemplary embodiments, for at least some steps of the method according to the embodiments, aspects and methods of manufacturing printed circuit boards (PCB) may advantageously be used, e.g. for arranging said first layer 110 of electrically conductive material on said first surface 130*a* of said at least one dielectric layer 130 and/or for arranging said second layer 120 of electrically conductive material on said second surface 130*b* of said at least one dielectric layer 130, and the like. According to further exemplary embodiments, the method of manufacturing the apparatus according to the embodiments may also efficiently be integrated into a process of manufacturing a printed circuit board. This way, it is e.g. also possible to efficiently provide a printed circuit board comprising one or more apparatus according to the embodiments.

Figure 8B:
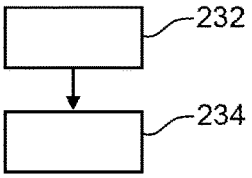

According to further exemplary embodiments, cf. the flow chart of FIG. 8B, said step of providing at least one distributed resonator structure 140 comprises: providing 232 at least one through hole th (FIG. 1) and/or at least one blind hole bh (FIG. 2), in said at least one dielectric layer 130, and optionally in said first layer 110 of electrically conductive material and/or in said second layer 120 of electrically conductive material.

According to further exemplary embodiments, said step of providing at least one distributed resonator structure 140 comprises providing 234 (FIG. 8B) an electrically conductive layer 141*a* on an inner surface of at least one of said holes th.

Figure 8C:
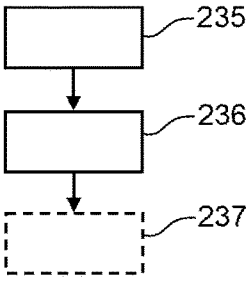

According to further exemplary embodiments, cf. the flow chart of FIG. 8C, said step of providing said at least one dielectric layer comprises providing a plurality 130' (FIG. 6A) of dielectric layers 131, 132, 133, 134, wherein said step of providing at least one distributed resonator structure 140 comprises: providing 235 (FIG. 8C) a plurality of holes 1411, . . . , 1414 in at least two of said plurality of dielectric layers 131, 132, 133, 150, arranging 236 said plurality of dielectric layers to form a stack 102 (FIG. 6B) of dielectric layers.

According to further exemplary embodiments, said step 236 of arranging is performed such that at least two holes 1411, 1412 (FIG. 6A) of adjacent dielectric layers 131, 132 of said stack are aligned with each other, e.g. forming a respective resonator post.

Optionally, a step of laminating 237 may be performed to obtain a monolithic stack 102 (FIG. 6B) according to further exemplary embodiments.

Figure 8D:
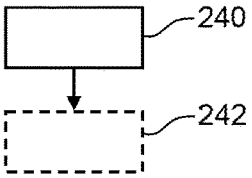

According to further exemplary embodiments, cf. the flow chart of FIG. 8D, said method further comprises: a) providing 240 a structured section on said first layer 110, 110' of electrically conductive material and/or said second layer 120, 120' of electrically conductive material and/or b) providing 242 at least one further layer 170 (FIG. 6A) of electrically conductive material and providing a structured section 172 on said at least one further layer 170 of electrically conductive material.

According to further exemplary embodiments, the components 110, 120, 130 of the apparatus may advantageously be used as a carrier for electric and/or electronic circuits, e.g. in the sense of a printed circuit board. In other words, exemplary embodiments enable to attain outer dimensions for the apparatus which are comparable to those of conventional printed circuit boards (PCB), so that according to further exemplary embodiments the apparatus may be integrated into such PCB.

According to further exemplary embodiments, the layer stack 102 of the apparatus may comprise a thickness t1 ranging from 10ths of millimetres to several (few) millimetres.

A further advantage of further exemplary embodiments is that the apparatus 100 or a system comprising the apparatus, such as e.g. the filter 1000 (FIG. 4), can be built directly into a PCB, e.g. together with further electric and/or electronic components, such as e.g. transceiver electronics. A direct integration of the apparatus according to the embodiments into a PCB according to further preferred embodiments may e.g. attain one or more of the following advantages: lead to low-loss transitions, low loss filters, tighter integration of a filter with remaining structures of e.g. a transceiver, no separate filter components may be required anymore.

According to further exemplary embodiments, the holes for providing one or more resonator posts 141, 142, . . . may e.g. be provided in the form of vias, wherein an inner surface of said vias is plated with an electrically conductive material.

According to further exemplary embodiments, tuning structures 145, 146, 147, 148 (FIGS. 6C, 7) may e.g. be implemented by vias that have tuning-pads 148 (FIG. 7) on a top that can be tuned by increasing or reducing the size of the pad 148, or by (small) screws 146 (FIG. 6C), or pins that are inserted into non-plated (blind) holes or vias 145 to varying depth, or by removing plating from an axial end section of a plated resonator post, or by removing ground plating 111 (FIG. 3A), e.g. from an opposite side of a sack hole forming a resonator post 142'.

Further preferred embodiments enable to provide filters 1000 for RF signals that may e.g. be used in telecommunications, e.g. mobile cellular base stations, fixed point-to-point radio systems, to name a few, as well as further fields of application, e.g. sensors of radar systems.

At least some preferred embodiments enable to provide filters that are small, lightweight, cost-efficient and easy to integrate into an overall electrical and mechanical design of a target system such as e.g. a transceiver circuit, especially also a respective PCB, wherein said filters may further provide excellent electrical performance such as e.g. a high band selectivity and/or a low insertion loss and/or power-handling characteristics.

According to further preferred embodiments, a multi-layer PCB manufacturing process may be used for manufacturing the apparatus according to the embodiments, or at least for performing some steps of manufacturing the apparatus according to the embodiments.

The invention claimed is:

1. An apparatus comprising a first layer of electrically conductive material, a second layer of electrically conductive material, and at least two dielectric layers, each of which comprises a respective solid dielectric material, the at least two dielectric layers being arranged between said first layer and said second layer;

wherein at least one distributed resonator structure comprising a plurality of resonator posts is arranged in said at least two dielectric layers; and wherein each of the resonator posts of the plurality of resonators posts comprises respective electrically conductive walls bounding a respective cavity in the at least two dielectric layers.

2. The apparatus of claim 1, wherein the respective electrically conductive walls of a first resonator post of said plurality of resonator posts make electrically conductive contact with said first layer, and wherein the respective electrically conductive walls of a second resonator post of said plurality of resonator posts is make electrically conductive contact with said second layer.

3. The apparatus of claim 1, wherein each of the respective cavities is at least a part of a respective through hole or of a respective blind hole in the at least two dielectric layers.

4. The apparatus of claim 1, wherein said first layer and said second layer comprise an electrically conductive plating or metallization arranged on a surface of said at least two dielectric layers.

5. The apparatus of claim 4, wherein said at least two dielectric layers comprise a layer of a first type of dielectric material and a layer of a second type of dielectric material, which is different from said first type of dielectric material.

6. The apparatus of claim 1, wherein the plurality of resonators posts comprises nine resonators posts which are arranged in three rows of three respective resonator posts in each of the three rows.

7. The apparatus of claim 1, wherein a feed line for providing an input signal to the apparatus is arranged on a surface of said at least two dielectric layers or on a surface of at least one further dielectric layer.

8. A printed circuit board comprising a first layer of electrically conductive material, a second layer of electrically conductive material, at least two dielectric layers, each of which comprises a respective solid dielectric material, the at least two dielectric layers being arranged between said first layer and said second layer;

wherein at least one distributed resonator structure comprising a plurality of resonator posts is arranged in said at least two dielectric layers; and wherein each of the resonator posts of the plurality of resonators posts comprises respective electrically conductive walls bounding a respective cavity in the at least two dielectric layers.

9. An apparatus comprising a first layer of electrically conductive material, a second layer of electrically conductive material, and at least one dielectric layer, which comprises a solid dielectric material, arranged between said first layer and said second layer;

wherein at least one distributed resonator structure comprising a plurality of resonator posts is arranged in said at least one dielectric layer;

wherein said first layer and said second layer comprise an electrically conductive plating or metallization arranged on a surface of said at least one dielectric layer or on a surface of at least one further dielectric layer; and wherein said at least one dielectric layer comprises a first type of dielectric material, and wherein said at least one further dielectric layer comprises a second type of dielectric material, which is different from said first type of dielectric material.

10. A filter for radio frequency, RF, signals (is) comprising at least one apparatus comprising a first layer of electrically conductive material, a second layer of electrically conductive material, and at least two dielectric layers, each of which comprises a respective solid dielectric material, the at least two dielectric layers being arranged between said first layer and said second layer;

wherein at least one distributed resonator structure comprising a plurality of resonator posts is arranged in said at least two dielectric layers; and wherein each of the resonator posts of the plurality of resonators posts comprises respective electrically conductive walls bounding a respective cavity in the at least two dielectric layers.

* * * * *